United States Patent [19]

Davis et al.

[11] 4,407,700

[45] Oct. 4, 1983

[54] INJECTOR FOR CALCINER

[75] Inventors: Richard L. Davis, Billings, Mont.; Harlan G. Graf, Ponca City, Okla.; Don L. Edwards, Ponca City, Okla.; William B. Macbeth, Jr., Ponca City, Okla.

[73] Assignee: Conoco Inc., Ponca City, Okla.

[21] Appl. No.: 388,338

[22] Filed: Jun. 14, 1982

[51] Int. Cl.[3] ..... C10B 1/04; C10B 49/06

[52] U.S. Cl. ..... 202/85; 201/17; 202/95; 202/99; 202/215

[58] Field of Search ..... 202/85, 88, 93, 95, 202/99, 214, 215, 239, 270; 201/17, 34, 37; 432/99, 233; 239/132.3, 139

[56] References Cited

U.S. PATENT DOCUMENTS

| | | | |
|---|---|---|---|
| 1,009,064 | 11/1911 | Gobbe | 202/88 |
| 1,756,969 | 5/1930 | Bergfeld | 202/85 |
| 2,595,366 | 5/1952 | Odell et al. | 201/17 |
| 2,719,779 | 10/1955 | Bray et al. | 202/99 |
| 2,757,129 | 7/1956 | Reeves et al. | 201/37 |
| 3,260,514 | 7/1966 | Asano et al. | 432/99 |
| 3,284,915 | 11/1966 | Berg | 432/99 |
| 3,488,044 | 1/1970 | Shepherd | 239/132.3 |
| 3,706,520 | 12/1972 | Grimm et al. | 239/132.3 |
| 4,022,569 | 5/1977 | Farago et al. | 432/14 |
| 4,053,365 | 10/1977 | Welter | 202/100 |
| 4,251,323 | 2/1981 | Smith | 201/29 |
| 4,322,033 | 3/1982 | Rymarchyk et al. | 239/132.3 |

*Primary Examiner*—Bradley Garris

*Attorney, Agent, or Firm*—Stephen A. Littlefield

[57] ABSTRACT

Combustion gas such as air, oxygen-enriched air or oxygen is introduced to a calcining zone at an intermediate level in a vertical shaft kiln for the calcining of petroleum coke utilizing a plurality of radially disposed combustion gas injectors and at least one vertically disposed injector located within the shaft kiln and extending into the calcining zone. The injector includes means for circulating coolant around the periphery of the injector so that common metals may be used in the high temperature (above 2000° F.) environment of the shaft kiln. The vertical combustion gas injector may extend from the top of the calcining chamber to the calcining zone or from the bottom of the calcining chamber to the calcining zone. When the vertical combustion gas injector extends vertically upwardly from the bottom of the calcining chamber, means for introducing recycle gas to the calcining chamber may be incorporated into the vertical combustion gas injector.

8 Claims, 4 Drawing Figures

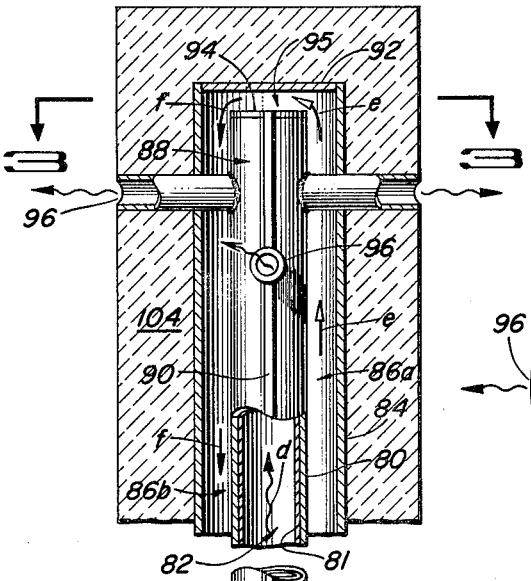
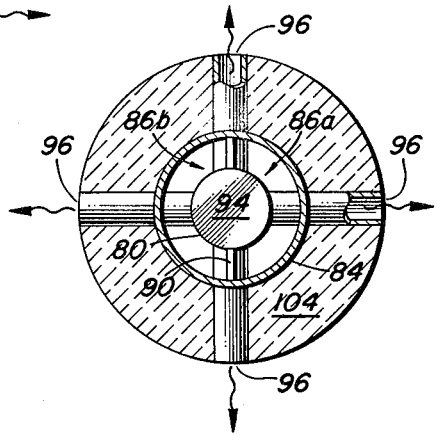
Fig. 3
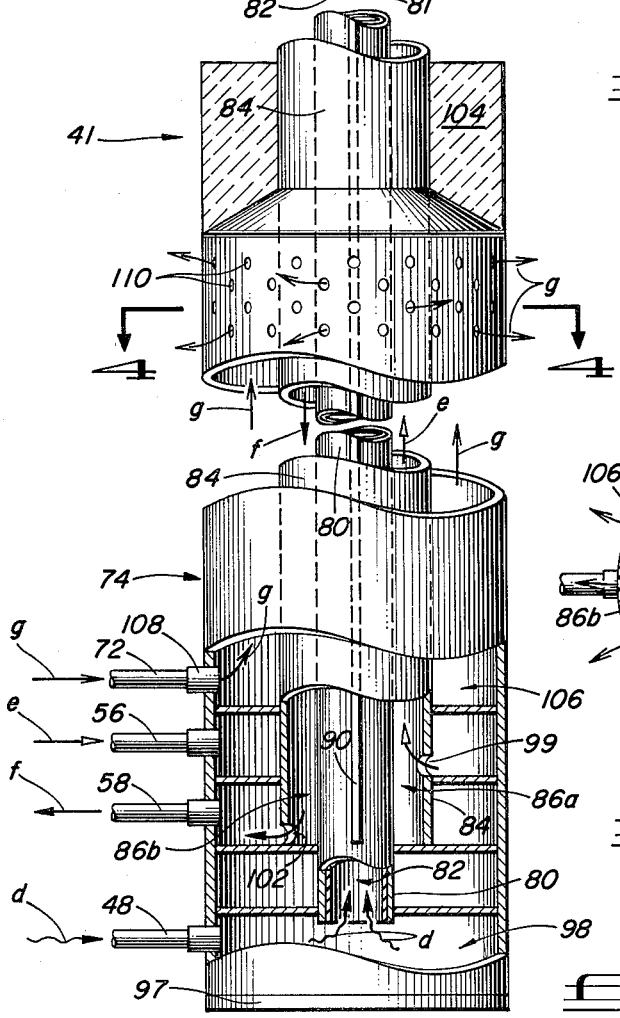
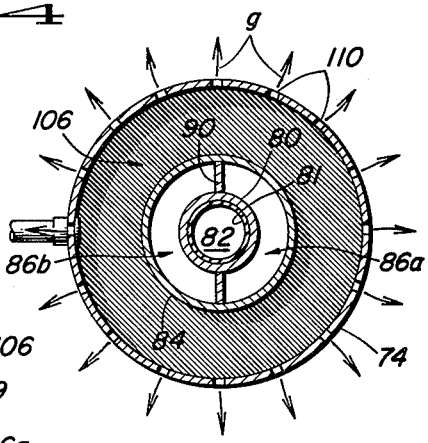
Fig. 4
Fig. 2

INJECTOR FOR CALCINER

This invention relates to the art of shaft kilns and more particularly, to a water cooled combustion gas injector for use in a high temperature, vertical calciner for coke.

BACKGROUND OF THE INVENTION

The following comprises a prior art statement in accordance with the guidance and requirements of 37 CFR Sections 1.56, 1.97 and 1.98.

Petroleum coke is generally calcined at high temperature to drive off volatile hydrocarbons and moisture. The calcined product may be used to produce anodes for aluminum manufacture or, in cases where the petroleum coke is needletype, premium coke, the calcined product may be used for the manufacture of graphite electrodes for use in electric arc steel making processes.

Most present day commercial petroleum coke calciners are the inclined, rotary kiln type in which the coke is tumbled in a high temperature atmosphere. Such a process requires a large amount of fuel to heat the kiln and there are large heat losses involved in this process. The operation of this type of rotary calciner is described in U.S. Pat. Nos. 4,022,569 and 4,053,365.

Another type of calciner used for calcining petroleum coke is described in U.S. Pat. No. 4,251,323. The coke is calcined in an internally fired, vertical shaft kiln. In the kiln, a moving bed of particulate material flows downwardly through the kiln and is preheated to calcining temperature and substantially devolatilized in the upper section by hot gases moving upwardly through the kiln. Combustion gas such as air, oxygen or oxygen-enriched air is introduced into a combustion zone where combustible components of a recycle gas, as well as some of the particulate material are burned. Combustion gases plus unburned recycle gas heat the downwardly moving bed of material to calcining temperatures in a calcining zone. The upwardly flowing gases preheat the incoming particulate material in the area above the calcining zone. Kiln off gases containing fines and volatile material in the form of vapor and/or mist are subjected to fines removal and scrubbing with the product being a low heat value product gas comprising carbon monoxide, hydrogen and low molecular weight hydrocarbons. A portion of this product gas or other oxygen-deficient gas is injected into the lower end of the kiln as recycle gas. The upwardly moving recycle gas (prior to combustion) cools the calcined material moving downwardly from the combustion zone so that the calcined product leaving the kiln is somewhat cooled and can be readily handled.

In the internally fired vertical shaft kiln of the aforementioned U.S. Pat. No. 4,251,323, combustion gas is injected into the kiln in the combustion zone through a series of water cooled conduits which are positioned transverse to the vertical cylindrical axis of the kiln. While this arrangement of injector tubes provides for good distribution of combustion gas, the presence of transverse bodies in the shaft kiln restricts the downward flow through bridging of the particulate carbonaceous material which is being calcined. Further, there is significant heat loss through absorption of the combustion heat by the coolant in the injector conduits. Such heat loss impairs the efficiency of the kiln since a greater amount of particulate material must be burned to raise the temperature to calcining temperature for the petroleum coke, generally in the range of 2000° F. to 3000° F., preferably above 2400° F. At such temperatures it is necessary to cool the injector conduits since the use of high temperature resistant metals would be impractical from a cost standpoint for this application and the use of mild steel without cooling would quickly result in failure of the injector conduit. Processing at these temperatures is difficult in a shaft kiln unlike the retorting of oil shale in which such high temperature and such critical control of such temperatures are not necessary.

In order to attain the required very high temperatures (above 2000° F.) in a large shaft kiln, it is necessary to provide heat uniformly through the cross-section of the kiln. Attempts to calcine petroleum coke in shaft kilns have been made utilizing externally fired kilns wherein the heat is generated in an annulus outside the coke containing vessel. This is not practical with a large, commercially-sized operation because of heat transfer as well as physical size problems. Attempts to calcine petroleum coke in electrically heated furnaces have also been unsuccessful on a commercial basis. Thus, in order to utilize the advantages of a shaft kiln in a large scale operation, it is necessary to use an internally fired kiln in which combustion gas is injected into an intermediate section of the kiln for combustion of recycle gas and coke to provide the necessary heat. The primary problem with development of an internally fired shaft kiln for calcining petroleum coke is in the provision of a combustion gas distributor which will tolerate the high temperatures necessary. Merely using a metal pipe grid such as is done in retorting of oil shale is not satisfactory, as the metals will not support the load of the coke bed at the temperatures involved.

SUMMARY OF THE INVENTION

The present invention provides for an injector for distributing combustion gas in a vertical, internally fired shaft kiln for the calcining of petroleum coke. The injector of this invention, in conjunction with other combustion gas injectors, provides for adequate distribution of combustion gas as well as allowing the use of metal injectors which are cooled so as to avoid problems at the high temperatures involved in the shaft kiln while not providing a heat drain which would lower the efficiency of the process.

In accordance with the invention, an internally fired vertical shaft kiln for the calcining of petroleum coke has a plurality of combustion gas injectors which project inwardly of the outer walls of the kiln and terminate within the inner, refractory walls of the kiln. The kiln further includes a vertically extending, water-cooled combustion gas injector having gas injection nozzles which inject combustion gas in a combustion zone defined by the side wall injectors and which is free standing inwardly of the side walls of the kiln. The vertical combustion gas injector is provided with water jacketing and internal means for directing the flow of coolant such as water to maintain the temperature of the metal injector at an acceptable level.

Further in accordance with the invention, the aforementioned vertical injector is surrounded by a layer of refractory material which insulates the water jacketing from the absorption of process heat thereby avoiding heat losses which decrease kiln efficiencies.

Further in accordance with the invention, the aforementioned vertical combustion gas injector projects downwardly from the top of the vertical shaft kiln to a combustion zone located at the gas injector orifices.

Still further in accordance with the invention, the aforementioned vertical combustion gas injector projects upwardly from the base of the shaft kiln and extends to the combustion zone defined by the gas injector orifices.

In yet another aspect of the invention, the aforementioned vertical combustion gas injector extending upwardly from the base of the shaft kiln further includes means near its base for injecting recycle gas into the central portion of the base of the shaft kiln.

It is therefore an object of this invention to provide a combustion gas distribution apparatus which provides even distribution of combustion gases in a vertical shaft kiln.

It is a further object of this invention to provide a combustion gas injection apparatus which does not cause bridging of the vertically moving bed of material within the kiln.

It is yet another object of this invention to provide combustion gas distribution system which utilizes common metal components with fluid cooling such that the coolant does not consume process heat thereby lower the efficiencies of the internally fired vertical shaft kiln process.

BRIEF DESCRIPTION OF THE DRAWINGS

These and other objects of the invention will appear through the understanding of a more detailed description of the invention which will be described hereinafter as a preferred embodiment thereof and illustrated in the accompanying drawings forming a part of this specification and in which:

FIG. 2 is a fragmented perspective view of one combustion gas injector in accordance with a preferred embodiment of the invention;

FIG. 3 is a cross-sectional view of the combustion gas injector shown in FIG. 2 taken along line 3—3 thereof, and FIG. 4 is a cross-sectional view of the combustion gas injector shown in FIG. 2 taken along line 4—4 thereof.

DETAILED DESCRIPTION OF THE PREFERRED EMBODIMENT AND THE DRAWINGS

Figure 1:
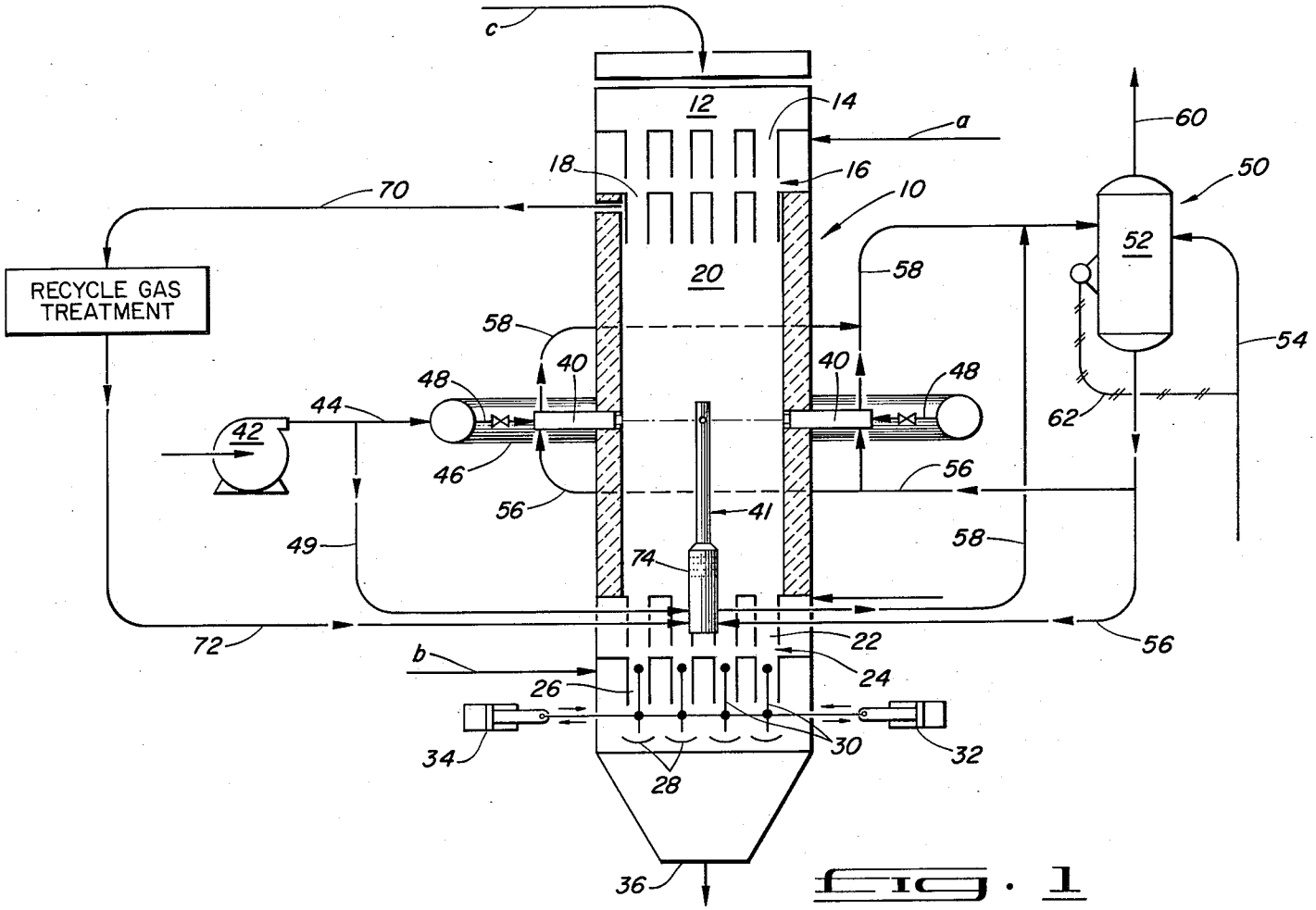
FIG. 1 is a schematic, cross-sectional view of an internally fired vertical shaft kiln for the calcining of petroleum coke in which the gas injectors of the invention are utilized.

Referring now to the drawings wherein the showings are for the purposes of illustrating a preferred embodiment of the invention only and not for the purpose of limiting same, FIG. 1 shows an internally fired vertical shaft kiln 10 of the type described in the aforementioned U.S. Pat. No. 4,251,323. The shaft kiln 10 is preferably cylindrical in form, although other configurations are possible, and is provided at its upper end with a feed hopper 12. The feed hopper 12 is provided with a plurality of upper feed inlet spouts 14 feeding into an upper seal gas chamber 16 in which a seal gas is continuously injected as shown at arrow a. The seal gas is provided to maintain positive pressure within the seal gas chamber 16 to prevent the venting of combustion product gases from within the shaft kiln to the atmosphere. The seal gas also prevents oxygen from entering the top of the kiln where heated product gases may be ignited. The seal gas chamber 16 is further provided with a plurality of downwardly extending feed tubes 18 which extend into the calcining chamber 20 of the shaft kiln 10.

The lower portion of the shaft kiln has a plurality of upper discharge spouts 22 leading into a second, lower seal gas chamber 24 which is similarly fed with a seal gas as shown at arrow b. From the lower seal gas chamber 24, lower discharge spouts 26 lead downwardly to discharge trays 28. Wiper blades 30 actuated by pistons 32 and 34 remove the coke from the trays 28 uniformly to maintain uniform flow from the kiln. Cooled, calcined product is withdrawn from the bottom of the kiln 36.

In the operation of the kiln, particulate material is fed into the feed hopper 12 at the top of the kiln as shown at arrow c. The particulate material passes downwardly through the feed inlet spouts 14, through the upper seal gas chamber 16 and through the lower feed tubes 18 into the interior of the calcining chamber 20 of the kiln 10. Once the charge in the kiln is preheated to operating temperature, the procedure for which will not be herein discussed since it is well known by those skilled in the art, the charge is self-sustaining with respect to the generation of heat so long as sufficient combustion gas is provided.

In this regard, combustion gas is provided to the kiln through a plurality of side injectors 40 and vertical gas injector 41 to be more fully described hereinafter. For the purposes of this specification, the term "combustion gas" will be understood to mean a gas which supports the combustion of combustible materials. Combustion gas may, therefore, be air, oxygen-enriched air or pure oxygen.

Combustion gas is fed to the injectors 40 through a system beginning at a blower 42 which feeds combustion gas through a combustion gas line 44 to a toroidal combustion gas manifold 46 disposed around the exterior of the shaft kiln 10. Although a toroidal manifold 46 is shown, it will be understood that any similar combustion gas distribution system may be provided such as a plenum chamber. Alternatively, an individual blower unit may be provided for each injector 40. Combustion gas is fed to the individual injectors 40 through an inlet line 48, which may include a valve for purposes of flow balance, to provide combustion gas to the calcining process within the shaft kiln 10.

In a similar manner, combustion gas is fed to the vertical combustion gas injector 41 through a combustion gas line 49 which is shown extending from feed blower 42 and the combustion gas line 44 which feeds the toroidal combustion gas manifold 46. It will be understood that other arrangements for feeding combustion gas to the vertical injector 41 may be provided such as an individual blower or take off from the toroidal manifold 46. Preheating of the combustion gas may also be provided for any of the gas injectors 40,41. It will be noted that only one vertical gas injector 41 is shown in FIG. 1. This is for the purpose of illustration only and it will be understood that the number of such vertical combustion gas distributors 41 and their arrangement in the vertical shaft kiln 10 is dependent on the overall size of the kiln. In a large kiln, a number of such vertical injectors would be distributed in a geometric array so as to provide an even distribution of combustion gas within the entire volume of the shaft kiln.

In order to maintain the combustion gas injectors 40, 41 at an acceptable low temperature, a coolant recirculation system generally designated as 50 is provided. The coolant recirculation system 50 may be of any type such as a passthrough system in which the coolant is discharged as waste or, as preferred and shown in FIG.

1, a recirculating system in which the coolant is reused in a closed loop system.

The coolant system 50 comprises a coolant tank 52 which is fed with makeup coolant through a feed line 54. Injector coolant is provided to each of the injectors 40, 41 through a coolant inlet lines 56 where it passes through the internal passages of the injectors 40, 41, as will be further described hereinafter, and is returned to the coolant tank 52 by return lines 58 where the coolant is processed to remove heat such as by aeration. Any steam produced by the coolant closed loop system is vented through vent line 60, the coolant level in the tank 52 being maintained by coolant additions through the feed line 54 and leveling in a return line 62.

It will be understood that other coolant systems may be provided, the important feature being that the coolant passes through the combustion gas injectors 40, 41. The coolant may be any fluid common in the art such as air or, preferably, water. When water is the coolant used, appropriate additives may be provided for corrosion inhibition and the like which are common in the art.

The combustion and calcining processes taking place within the charge of the shaft kiln 10 produces a considerable amount of gas. The off gas comprises shield gas (generally $CO_2$ and nitrogen), volatilized hydrocarbons, and particulate coke fines, as well as combustible gaseous materials such as hydrogen, carbon monoxide and low molecular weight hydrocarbons. These combustion off gases are taken from the top of the shaft kiln through a recycle gas outlet line 70 for recycle gas treatment. The aforementioned U.S. Pat. No. 4,251,323 fully describes the treatment of recycle gas. Recycle gas treatment includes removal of fines through cyclonic treatment, scrubbing to cool the gas and remove condensable hydrocarbons and returning a portion of the recycle gas to the lower part of the kiln 10 through a recycle gas return line 72. Any oxygen-deficient gas may be used in lieu or in place of recycled combustion off gases. Excess off gas constitutes a low heat value product gas which may be used for processes other than those directly associated with the operation of the kiln 10.

Recycle gas is fed through the recycle gas return line 72 to an injector 74 which, in one embodiment of this invention, comprises a cylindrical distributor located near the base of the vertical gas injector 41. This embodiment will be more fully described hereinafter. With other embodiments hereinafter described, it will be understood that any form of recycle gas injector 74 from any positioning generally in the bottom of the kiln 10 may be utilized.

In the operation of the kiln 10, recycle gas entering at the bottom of the kiln passes upwardly through the downwardly moving charge of coke. The recycle gas cools the calcined coke material which has passed downwardly below the combustion zone so that the temperature of the calcined coke is reduced significantly prior to its discharge from the bottom of the kiln 36. As the recycle gas passes upwardly, it passes into the zone wherein the combustion gas which preferably comprises air or oxygen-enriched air is injected. The heat of the kiln at that point ignites the recycle gas and a portion of the coke to sustain the heating process within the kiln.

In order to obtain a satisfactory calcined product, it is essential that the green petroleum coke be subjected to a calcining temperature of at least 2000° F. for a period of at least one hour. The calcining may take place at a temperature from about 2000° to about 3000° F. for a period of one to ten hours. Preferably, the green coke is subjected to temperatures above 2400° F. in a soaking zone (above the combustion zone) for at least two hours, and in some cases, particularly where the green coke has a high sulfur content, a temperature above 2600° F. for at least two hours is desirable. Most preferably, the coke is calcined at a temperatue of from 2400° to 2800° F. for a period of two to five hours.

As stated previously, the combustion gas is injected in an area approximately halfway up in the calciner through a plurality of side combustion gas injectors 40. The side combustion gas injectors 40 are disposed radially around the periphery of the kiln to provide uniform combustion gas distribution. It will be understood, however that other orientations of the injectors 40 are possible. As a supplement to the combustion gas injection from the side injectors 40, at least one vertical combustion gas injector 41 is provided within the calcining chamber 20 of the shaft kiln 10. In one preferred embodiment of the invention as shown in FIG. 1, the vertical combustion gas injector 41 extends vertically upwardly from the bottom of the calcining chamber 20 to the combustion zone of the kiln, a level which approximates that of the side combustion gas injectors 40. In other embodiment of the invention, the vertical combustion gas injector 41 may extend downwardly from the upper seal gas chamber 16 into the calcining chamber 20 to the combustion zone at the level of the side combustion gas injectors 40. It will be further understood that while only a single, centrally disposed vertical combustion gas injector 41 is shown in the drawing, a plurality of such vertical injectors 41 extending either vertically upwardly from the base of the calcining chamber 20 or vertically downwardly from the top portion of the calcining chamber 20 may be provided as necessary to achieve adequate combustion gas distribution within the calcining zone located at or near the side combustion gas injectors 40.

As best shown in FIGS. 2, 3 and 4, a vertical combustion gas injector 41 generally comprises a pair of coaxial tubular members in which the inner tubular member 80 has a refractory lining 81 and defines a combustion gas passageway 82 through the interior thereof. The provision of a refractory lining 81 is optional for the purpose of limiting heat loss from combustion gas which may be preheated prior to injection. A second, outer tubular member 84 defines a longitudinally divided annular space **86*a*, 86*b* between its inner surface and the outer surface of inner tubular member 80. The annular space 86*a*, 86*b* is provided for the circulating flow of coolant such as water to keep the inner tubular member 80, and particularly its upper end 88 disposed at the combustion zone of the kiln 10**, at a relatively cool temperature.

The annular space **86*a*, 86*b* is divided by a pair of longitudinally disposed baffle walls 90 into semi-annular space 86*a* and semi-annular space 86*b***.

The annular space **86*a*, 86*b* is closed off at the end 88 with a plate member 92. The inner tubular member 80 is similarly closed off with a plate member 94. A space 95 is defined between the plate members 92 and 94 which allows fluid communication and circulation between the semi-annular spaces 86*a*, 86*b***.

A plurality of radially disposed combustion gas injector nozzles 96 are provided to the inner tubular member 80 in fluid communication with the combustion gas passageway 82. Four nozzles 96 are shown in the figures which are spaced from the end plate member 94 and disposed radially and extend outwardly from the inner tubular member 80, through the annular space 86*a*, 86*b* and extending outwardly through the exterior wall of outer tubular member 84. It will be understood that the arrangement and number of the nozzles 96 are illustrative only and that other arrangements and numbers of nozzles 96 are possible within the scope of the invention.

A plate or flange 97 is welded to the lower end of combustion gas injector. Combustion gas is provided through the combustion gas conduit 48 to a fitting which opens into the space 98 at the lower end of the injector 41 with the combustion gas passing through the central combustion gas passageway 82 of inner tubular member 80 in the direction of the arrows d. Combustion gas exits the injector 41 into the combustion zone of the shaft kiln 10 through the nozzles 96.

Coolant is provided to the annular space 86*a*, 86*b* through the coolant inlet line 56 connecting to a coolant inlet opening 99 through the wall of the outer tubular member 84 into the semi-annular space 86*a*. It should be noted that the longitudinal baffle members 90 terminate within the annular space 86 short of the inward end 88 of the injector 41. This permits the flow of coolant in the direction of arrows e upwardly along the semi-annular space 86*a* to the end plate member 94 of the inner tubular member 80 and return downwardly in the direction of arrows f through the semi-annular space 86*b* to an outlet opening 102 which connects through the outer tubular member 84 to the coolant return line 58 of the coolant system 50 as previously described.

A sheath of refractory material 104 is provided on the outer surface of the outer tubular member 84 is at least at the end 88 of the injector 41. Preferably, as shown in the figures, the refractory sheath 104 extends over substantially the entire length of the outer tubular member 84.

The vertical combustion gas injector 41 comprises inner and outer tubular members 80 and 84 respectively with a divided annular coolant recirculation space 86*a*, 86*b* separating them. The outer tubular member 84 is further covered over at least a portion of its length by a refractory sheath 104. Combustion gas injector nozzles 96 extend outwardly from the inner tubular member 80 through the annular coolant circulation space 86*a*, 86*b*, through the wall of outer tubular member 84 and end at the exterior surface of the refractory sheath 104.

The vertical combustion gas injector 41 is mounted so as to extend vertically within the calcining chamber 20 of the vertical shaft kiln 10. In this regard, the end 88 of the injector 41 is located within the combustion zone of the calcining chamber 20 at a position approximating the vertical center thereof, being generally adjacent to the side combustion gas injectors 40. It can be seen that the vertical combustion gas injector 41 may thus be mounted in either a vertically downwardly extending manner wherein the plate or flange 97 may be connected by appropriate means to the upper end of the calcining chamber 20 such as by mounting within the seal gas chamber 16 between the lower feed tubes 18 or, as shown in the figures, extending vertically upwardly from the lower end of the calcining chamber 20 by an appropriate mounting means located such as in the lower seal gas chamber 24.

When the vertical combustion gas injector 41 is located so as to extend vertically upwardly from the lower portion of the shaft kiln 10, it is convenient to also provide for the injection of recycle gas through a recycle gas distributor 74 which is disposed around and concentric with the inner and outer tubular members 80, 84. An annular recycle gas injector chamber 106 is thus provided defined by the inner wall of the cylindrical recycle gas distributor 74 and the outer surface of the outer tubular member 84. A connector 108 is provided for connecting the recycle gas inlet line 72 to the distributor 74. A plurality of generally radially extending orifices 110 are provided in the upper portion of the recycle gas distributor 74 as illustrated in the figures. Recycle gas entering through the recycle gas connector 108 passes upwardly within the recycle gas distributor 74 and outwardly through the radially disposed orifices 110 in the direction of arrows g. It will be understood that the concentric mounting of the recycle gas distributor 74 around the base of a vertically upwardly extending combustion gas distributor 41 offers distinct design advantages and features which, although desirable, are not essential to the functioning of the vertical combustion gas injectors 41 in accordance with this invention. Thus, other means for distributing recycle gas within the shaft kiln 10 known in the art may be provided.

From the foregoing, it can be clearly seen that the present invention provides for a vertical injector 41 for the distribution of combustion gas in a vertical, internally fired shaft kiln 10 for the calcining of petroleum coke. The vertical combustion gas injector 41 of this invention, in conjunction with other radial combustion gas injectors 40, provides for excellent distribution of combustion gas as well as allowing the use of vertically extending metal injectors which are cooled through a divided annular coolant passage 86*a*, 86*b* so as to avoid problems at the high temperatures involved in the processing within the shaft kiln 10 while avoiding heat losses which would lower the efficiencies of the processes.

The foregoing illustrates that, in accordance with the invention, an internally fired vertical shaft kiln 10 for the calcining of petroleum coke having a plurality of radially disposed combustion gas injectors 40 which project inwardly from the outer walls of the kiln and terminate within the inner, refractory walls of the kiln further includes a vertically extending, fluid cooled combustion gas injector 41 having gas injection nozzles 96 which inject combustion gas in a combustion zone in the area of the side wall injectors 40 and is free standing inwardly of the side walls. The vertical combustion gas injector 41 is provided with coolant jacketing and internal means 90 for directing the flow of coolant such as water to maintain the temperature of the metal injector at an acceptable level despite the high temperatures involved in the petroleum coke calcining process. It has further been shown that the aforementioned vertical combustion gas injector 41 is preferably surrounded by a layer of refractory material 104 over at least a portion of its vertical length which insulates the coolant jacketing from the absorption of process heat thereby avoiding heat losses which decrease kiln efficiencies.

It has further been shown that a vertical combustion gas injector 41 may project downwardly from the top of the vertical shaft kiln 10 to a combustion zone located generally at the level of the side combustion gas injectors 40.

It has further been shown that the vertical combustion gas injector 41 may, in accordance with another aspect of this invention, project upwardly from the base of the shaft kiln 10 and extend to the combustion zone defined by the horizontally and radially disposed combustion gas injectors 40 located within the side walls of the shaft kiln 10.

It has still further been shown that means for injecting recycle gas 74 may be associated with a vertically upwardly extending vertical combustion gas injector 41 for injecting recycle gas into the central portion of the base of the shaft kiln 10.

While the invention has been described in the more limited aspects of the preferred embodiment thereof, other embodiments have been suggested and still others will occur to those skilled in the art upon the reading and understanding of the foregoing specification. It is intended that all such embodiments be included within the scope of the invention as limited only by the appended claims.

What is claimed is:

1. In an internally fired, vertical shaft kiln for the calcining of petroleum coke comprising a vertical shaft kiln having a top and bottom and an outer wall and an inner refractory wall, means for providing green particulate petroleum coke to a calcining chamber within the shaft kiln defined by upper and lower chamber walls and said inner refractory wall, means for removing calcined coke from said calcining chamber at the bottom of said shaft kiln and means for introducing recycle gas to the interior of the shaft kiln near the bottom thereof and means for introducing combustion gas to the interior of said shaft kiln comprising a plurality of radially disposed combustion gas injectors located at an intermediate level within said shaft kiln and defining a combustion zone therewithin, the improvement which comprises at least one vertical tubular combustion gas injector for injecting a combustion gas into said combustion zone, said vertical injector having a longitudinal central orifice and extending vertically within said calcining chamber and terminating in said combustion zone, said vertical injector having an annular coolant circulation space disposed therearound, coolant within said circulation space and means for providing said coolant to said annular space.

2. The improvement as set forth in claim 1 further including a refractory sheath surrounding said vertical combustion gas injector at least along its length located within said combustion zone.

3. The improvement as set forth in claim 1 wherein a plurality of said vertical tubular combustion gas injectors extend vertically within said calcining chamber.

4. The improvement as set forth in claim 1 wherein said vertical tubular combustion gas injector extends vertically downwardly from said upper chamber wall of said calcining chamber to said combustion zone.

5. The improvement as set forth in claim 1 wherein said vertical tubular combustion gas injector extends vertically upwardly from said lower chamber wall of said calcining chamber to said combustion zone.

6. The improvement as set forth in claim 5 wherein said annular coolant circulation space is divided by a pair of longitudinal baffles extending for a substantial portion of the length of said vertical tubular combustion gas injector.

7. The improvement as set forth in claim 6 wherein said means for introducing recycle gas comprises a cylindrical recycle gas distributor disposed circumferentially around the vertical tubular combustion gas injector adjacent said lower chamber wall of said calcining chamber.

8. The improvement as set forth in claim 1 wherein said annular coolant circulation space is divided by a pair of longitudinal baffle walls extending for a substantial portion of the length of said vertical tubular combustion gas injector.

* * * * *